US009627108B2

(12) United States Patent
Yamashita

(10) Patent No.: US 9,627,108 B2
(45) Date of Patent: Apr. 18, 2017

(54) METHOD AND APPARATUS FOR MANUFACTURING METAL MATERIAL AND METAL MATERIAL

(71) Applicant: Canon Denshi Kabushiki Kaisha, Chichibu-shi (JP)

(72) Inventor: Hiroshi Yamashita, Isahaya (JP)

(73) Assignee: CANON DENSHI KABUSHIKI KAISHA, Chichibu-Shi (JP)

( * ) Notice: Subject to any disclaimer, the term of this patent is extended or adjusted under 35 U.S.C. 154(b) by 207 days.

(21) Appl. No.: 13/854,430

(22) Filed: Apr. 1, 2013

(65) Prior Publication Data

US 2013/0213536 A1 Aug. 22, 2013

Related U.S. Application Data

(63) Continuation of application No. PCT/JP2011/073404, filed on Oct. 12, 2011.

(30) Foreign Application Priority Data

Oct. 13, 2010 (JP) ..... 2010-230325

(51) Int. Cl.
*C22F 1/14* (2006.01)
*H01B 13/00* (2006.01)
(Continued)

(52) U.S. Cl.
CPC ..... *H01B 13/0016* (2013.01); *C22F 1/02* (2013.01); *C22F 1/04* (2013.01); *C22F 1/08* (2013.01);
(Continued)

(58) Field of Classification Search
CPC ..... C22F 1/14
(Continued)

(56) References Cited

U.S. PATENT DOCUMENTS 4,457,787 A * 7/1984 Shibata ..... 148/678
4,976,792 A 12/1990 Sawada
2007/0006950 A1 1/2007 Okada et al.

FOREIGN PATENT DOCUMENTS

CN 1942600 A 4/2007
JP 60-003808 A 1/1985
(Continued)

OTHER PUBLICATIONS

International Search Report in Application No. PCT/JP2011/073404 (Jan. 2012).

*Primary Examiner* — Brian Walck
(74) *Attorney, Agent, or Firm* — Fitzpatrick, Cella, Harper & Scinto

(57) ABSTRACT

The present invention provides a method for manufacturing a metal material. The method comprises a temperature increasing step of increasing the temperature of a silver material having undergone final plastic working to 700° C. or more and less than a melting point of the silver material in a vacuum or a helium gas atmosphere, a heating step of maintaining the silver material at 700° C. or more and less than the melting point, and a cooling step of cooling the silver material to room temperature in a vacuum or a helium gas atmosphere. For a part of the period of the heating step, the silver material is heated in a mixed atmosphere in which hydrogen gas is mixed with helium gas.

3 Claims, 5 Drawing Sheets

(51) Int. Cl.

| | |
|---|---|
| ***C22F 1/02*** | (2006.01) |
| ***H01B 1/02*** | (2006.01) |
| ***C22F 1/04*** | (2006.01) |
| ***C22F 1/08*** | (2006.01) |

(52) U.S. Cl.
CPC ..... *C22F 1/14* (2013.01); *H01B 1/02* (2013.01); *H01B 1/023* (2013.01); *H01B 1/026* (2013.01)

(58) Field of Classification Search
USPC ..... 148/678
See application file for complete search history.

(56) References Cited

FOREIGN PATENT DOCUMENTS

| | | | |
|---|---|---|---|
| JP | 61-163505 | A | 7/1986 |
| JP | 63-174217 | A | 7/1988 |
| JP | 4-308608 | A | 10/1992 |
| JP | 11-172389 | A | 6/1999 |
| JP | 11-339568 | A | 12/1999 |
| JP | 2003-129202 | A | 5/2003 |
| KR | 10-0368063 | B1 | 1/2003 |
| WO | 2005/098071 | A1 | 10/2005 |
| WO | 2012/050118 | A1 | 4/2012 |

* cited by examiner

51
PRESSURE SENSOR
52
TEMPERATURE SENSOR
1
41
46
45
P
40
12
12
11
20
10
25
15
30
31
13
POWER SUPPLY SOURCE
33
32
He
90
CONTROL UNIT
34
H2
35

METHOD AND APPARATUS FOR MANUFACTURING METAL MATERIAL AND METAL MATERIAL

BACKGROUND OF THE INVENTION

Field of the Invention

The present invention relates to a metal material and a method for manufacturing the same, and particularly relates to, for example, a silver material, a copper material, and an aluminum material that are used for power transmission cables, wiring materials between audio devices or electronic devices, or between components thereof, bonding wires, and the like.

Description of the Related Art

Oxygen-free copper (OFC), silver-containing and oxygen-free copper, zirconium-containing and oxygen-free copper, and the like are widely used as wiring materials for connecting electronic components constituting audio equipment or video equipment. These wiring materials are known to have relatively high electric conduction efficiency compared to commonly used copper wires, but are also known to have fine crystal structures, and thus grain boundaries, which exist in the direction in which electrons are conducted, and impurities such as sulfides and intermetallic compounds have adverse effects on the electric conduction efficiency. The reason for this seems to be that grain boundaries and impurities accumulated therein cause an increase in electrical resistance, or serve as capacitors having very small capacitance, which leads to introduction of electrostatic capacity.

To achieve an improvement in this respect, the technique disclosed in Japanese Patent Laid-Open No. S60-003808 performs coarsening of crystal grains of OFC by heat treatment and then performs wire drawing to orient the crystal grains in the longitudinal direction. This technique is to decrease the number of grain boundaries by significantly coarsening the crystal grains, but the coarsened crystal grains are unfortunately destroyed by external stress in the process of manufacture of a metal material through plastic working called wire drawing, thus disturbing the crystal structure and causing lattice defects such as lattice vacancies and dislocations. This then results in the problem that these lattice defects act to cause an increase in electrical resistance and the formation of electrostatic capacity as with impurities.

In general, metals that have been deformed by plastic working such as rolling cause working strain, producing lattice distortions, defects and the like in the crystals. The technique disclosed in Japanese Patent Laid-Open No. S63-174217, which focuses on an improvement in the manufacturing process of metal materials, is intended to solve this problem.

Japanese Patent Laid-Open No. S63-174217 discloses that a manufactured metal material has outstanding signal transmission characteristics by using, as a signal transmission copper wire, a linear-bar-shaped ingot having a single-crystal structure or a directionally solidified structure in the longitudinal direction of OFC, or the linear-bar-shaped ingot on which plastic working has been applied by slight wire drawing or the like, and providing the copper wire with an electrical conductivity of 100% IACS (International Anneld Copper Standard) or more, or a tensile strength of 20 $kg/mm^2$ or less.

This technique was achieved by improving the problem wherein the above-described lattice defects produced during working have been a cause of deterioration in signal transmission characteristics. Meanwhile, a directionally solidified structure has a smaller number of grain boundaries, which prevent the movement of electrons, and oxygen, and hydrogen gas, and other impurities are discharged from the solidification interface into molten metal during casting, making defects less likely to be caused thereby.

Microscopically, metal materials having a polycrystalline structure inevitably experience losses during electrical conduction due to the presence of many grain boundaries therein. The technique according to Patent reference 2 achieves improved signal transmission characteristics by using a signal transmission copper wire formed from a linear-bar-shaped ingot having a single-crystal structure or a directionally solidified structure in the longitudinal direction, or the linear-bar-shaped ingot on which plastic working has been applied by slight wire drawing or the like. However, provision of linear-bar-shaped ingots having a single-crystal structure and a directionally solidified structure requires a very complicated metal solidification control process by heating casting mold continuous casting or the Czochraski method, as well as a great amount of time, resulting in the disadvantages of enormous cost and extreme difficulty in achieving mass production within a predetermined time period.

This has resulted in a critical problem in that the materials are expensive and can be obtained only in small quantities, preventing their industrial application. Additionally, this method requires an even longer time for formation of a wire rod having a large diameter, thus inevitably making the manufacture of a plate-shaped material and a strip-shaped material very difficult.

SUMMARY OF THE INVENTION

The present invention has been made in view of the above-described problems. The present invention provides a metal material having excellent mass productivity and high electric conduction efficiency, and a method for manufacturing the same.

A method for manufacturing a metal material according to a first aspect of the present invention includes: a temperature increasing step of increasing the temperature of a silver material having undergone final plastic working to 700° C. or more and less than a melting point of the silver material in a vacuum or a helium gas atmosphere; a heating step of maintaining the silver material at 700° C. or more and less than the melting point; and a cooling step of cooling the silver material to room temperature in a vacuum or a helium gas atmosphere, wherein, for a part of the period of the heating step, the silver material is heated in a mixed atmosphere in which hydrogen gas is mixed with helium gas.

A method for manufacturing a metal material according to a second aspect is the method for manufacturing a metal material according to the first aspect, wherein, during the heating step, atmosphere exchange is repeated three times or more, in which a vacuum atmosphere is created in an area surrounding the silver material by evacuation and then helium gas and hydrogen gas are supplied to create the mixed atmosphere.

A method for manufacturing a metal material according to a third aspect is the method for manufacturing a metal material according to the first or second aspect, wherein the time for the cooling step is at least twice the total time of the time for the temperature increasing step and the time for the heating step.

A method for manufacturing a metal material according to a fourth aspect includes: a temperature increasing step of increasing the temperature of a copper material having undergone final plastic working to 800° C. or more and less than a melting point of the copper material in a vacuum or a helium gas atmosphere; a heating step of maintaining the copper material at 800° C. or more and less than the melting point; and a cooling step of cooling the copper material to room temperature in a vacuum or a helium gas atmosphere, wherein, for a part of the period of the heating step, the copper material is heated in a mixed atmosphere in which hydrogen gas is mixed with helium gas.

A method for manufacturing a metal material according to a fifth aspect is the method for manufacturing a metal material according to the fourth aspect, wherein, during the heating step, atmosphere exchange is repeated three times or more, in which a vacuum atmosphere is created in an area surrounding the copper material by evacuation and then helium gas and hydrogen gas are supplied to create the mixed atmosphere.

A method for manufacturing a metal material according to a sixth aspect is the method for manufacturing a metal material according to the fourth or fifth aspect, wherein the time for the cooling step is at least twice the total time of the time for the temperature increasing step and the time for the heating step.

A method for manufacturing a metal material according to a seventh aspect includes: a temperature increasing step of increasing the temperature of an aluminum material having undergone final plastic working to 500° C. or more and less than a melting point of the aluminum material in a vacuum or a helium gas atmosphere; a heating step of maintaining the aluminum material at 500° C. or more and less than the melting point; and a cooling step of cooling the aluminum material to room temperature in a vacuum or a helium gas atmosphere, wherein, for a part of the period of the heating step, the aluminum material is heated in a mixed atmosphere in which hydrogen gas is mixed with helium gas.

A method for manufacturing a metal material according to an eighth aspect is the method for manufacturing a metal material according to the seventh aspect, wherein, during the heating step, atmosphere exchange is repeated three times or more, in which a vacuum atmosphere is created in an area surrounding the aluminum material by evacuation and then helium gas and hydrogen gas are supplied to create the mixed atmosphere.

A method for manufacturing a metal material according to a ninth aspect of the invention is the method for manufacturing a metal material according to the seventh or eighth aspect, wherein the time for the cooling step is at least twice the total time of the time for the temperature increasing step and the time for the heating step.

A metal material according to a tenth aspect is a metal material in which at least either helium molecules or hydrogen molecules are filled in grain boundaries of a silver material by the method for manufacturing a metal material according to any one of the first to third aspects.

A metal material according to an eleventh aspect is a metal material in which at least either helium molecules or hydrogen molecules are filled in grain boundaries of a copper material by the method for manufacturing a metal material according to any one of the fourth to sixth aspects.

A metal material according to a twelfth aspect is a metal material in which at least either helium molecules or hydrogen molecules are filled in grain boundaries of an aluminum material by the method for manufacturing a metal material according to any one of the seventh to ninth aspects.

The method for manufacturing a metal material according to the first to third aspects includes: a temperature increasing step of increasing the temperature of a silver material having undergone final plastic working to 700° C. or more and less than the melting point of the silver material in a vacuum or a helium gas atmosphere; a heating step of maintaining the silver material at 700° C. or more and less than the melting point; and a cooling step of cooling the silver material to room temperature in a vacuum or a helium gas atmosphere, wherein, for a part of the period of the heating step, the silver material is heated in a mixed atmosphere in which hydrogen gas is mixed with helium gas. Thus, the overall structure of the silver material can be constituted by coarsened, recrystallized grains, and at least either helium molecules or hydrogen molecules are filled in grain boundaries of the recrystallized grains, making it possible to impart high electric conduction efficiency to the silver material. Furthermore, a considerable amount of the silver material can be treated by one heat treatment, and thus excellent mass productivity is also achieved.

The method for manufacturing a metal material according to the fourth to sixth aspects includes: a temperature increasing step of increasing the temperature of a copper material having undergone final plastic working to 800° C. or more and less than a melting point of the copper material in a vacuum or a helium gas atmosphere; a heating step of maintaining the copper material at 800° C. or more and less than the melting point of the copper material; and a cooling step of cooling the copper material to room temperature in a vacuum or a helium gas atmosphere, wherein, for a part of the period of the heating step, the copper material is heated in a mixed atmosphere in which hydrogen gas is mixed with helium gas. This allows the overall structure of the copper material to be constituted by coarsened, recrystallized grains, and at least either helium molecules or hydrogen molecules are filled in grain boundaries of the recrystallized grains, thus making it possible to impart high electric conduction efficiency to the copper material. Furthermore, a considerable amount of the copper material can be treated by one heat treatment, and thus excellent mass productivity is also achieved.

The method for manufacturing a metal material according to the seventh to ninth aspects includes: a temperature increasing step of increasing the temperature of an aluminum material having undergone final plastic working to 500° C. or more and less than a melting point of the aluminum material in a vacuum or a helium gas atmosphere; a heating step of maintaining the aluminum material at 500° C. or more and less than the melting point; and a cooling step of cooling the aluminum material to room temperature in a vacuum or a helium gas atmosphere, wherein, for a part of the period of the heating step, the aluminum material is heated in a mixed atmosphere in which hydrogen gas is mixed with helium gas. This allows the overall structure of the aluminum material to be constituted by coarsened, recrystallized grains, and at least either helium molecules or hydrogen molecules are filled in grain boundaries of the recrystallized grains, thus making it possible to impart high electric conduction efficiency to the aluminum material. Furthermore, a considerable amount of the aluminum material can be treated by one heat treatment, and thus excellent mass productivity is also achieved.

With the metal material according to the tenth aspect, at least either helium molecules or hydrogen molecules are filled in grain boundaries of a silver material, and thus the metal material has high electric conduction efficiency.

With the metal material according to the eleventh aspect, at least either helium molecules or hydrogen molecules are filled in grain boundaries of a copper material, and thus the metal material has high electric conduction efficiency.

With the metal material according to the twelfth aspect, at least either helium molecules or hydrogen molecules are filled in grain boundaries of an aluminum material, and thus the metal material has high electric conduction efficiency.

Further features of the present invention will become apparent from the following description of exemplary embodiments (with reference to the attached drawings).

DESCRIPTION OF THE EMBODIMENTS

Hereinafter, an embodiment of the present invention will be described in detail with reference to the drawings.

Figure 1:
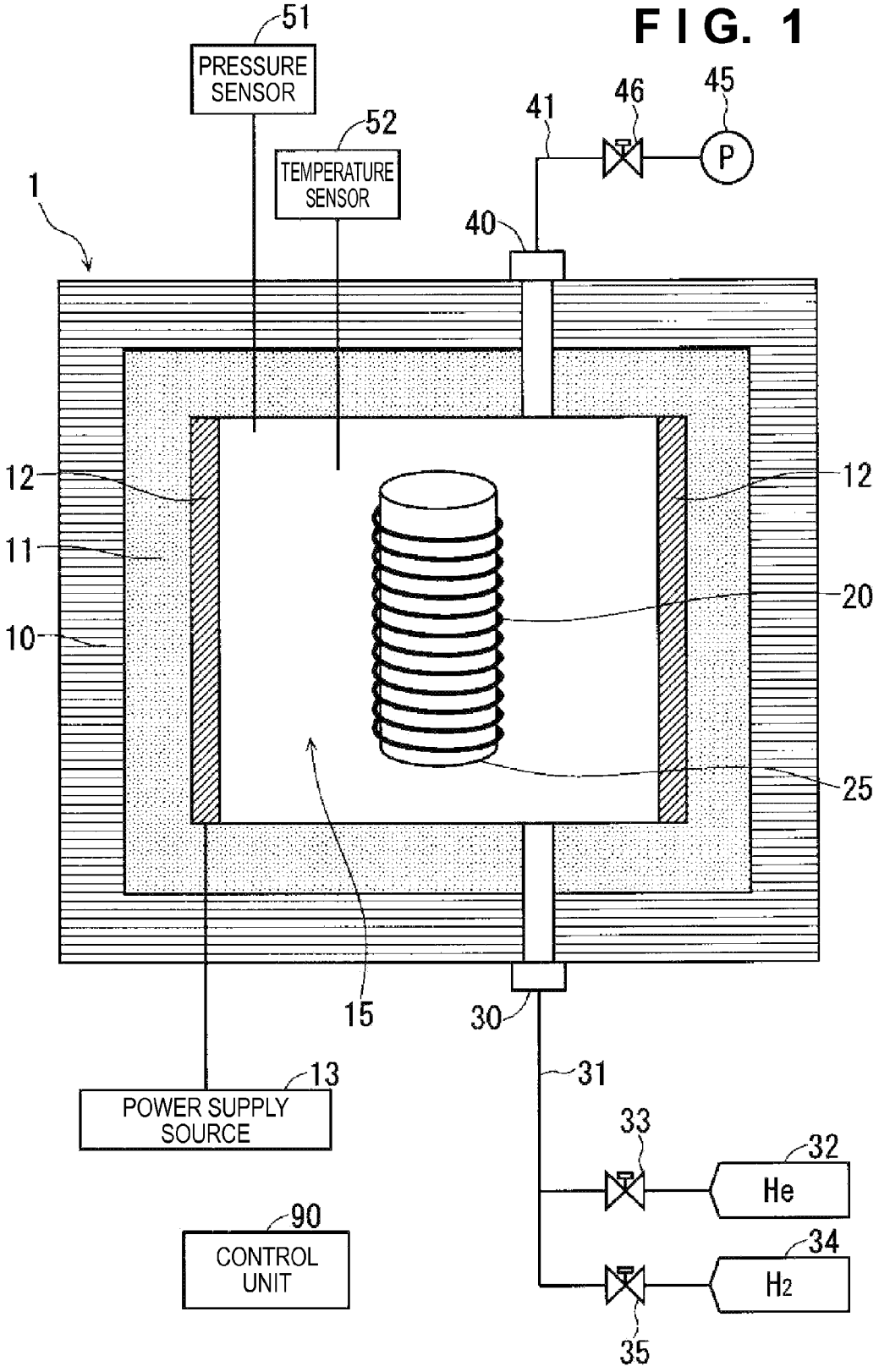
FIG. 1 depicts the configuration of a vacuum furnace used for a method for manufacturing a metal material according to the present invention.

FIG. 1 depicts the configuration of a vacuum furnace 1 used for a method for manufacturing a metal material according to the present invention. The vacuum furnace 1 is a heating furnace for heat-treating a sample in a vacuum atmosphere or a predetermined gas atmosphere. The vacuum furnace 1 is formed by providing an electric furnace 11 inside a casing 10. A heating element 12 is provided on the side wall of the electric furnace 11, and the space surrounded by the heating element 12 serves as a heat treatment space 15. The sample can be accommodated in and removed from the heat treatment space 15 via a door, which is not shown. In the present embodiment, a quartz pipe 25 capable of withstanding high temperatures with a wire-like metal material (wire rod) wound therearound is accommodated in the heat treatment space 15.

The heating element 12 is connected to a power supply source 13 via a power line. The heating element 12 generates heat upon receipt of power supply from the power supply source 13, and increases the temperature of the heat treatment space 15. The amount of power supplied by the power supply source 13 to the heating element 12 is controlled by a control unit 90.

The vacuum furnace 1 is provided with an intake port 30 for supplying a gas to the heat treatment space 15 and an exhaust port 40 for exhausting gas from the heat treatment space 15. The intake port 30 is connected in communication with a helium feeder 32 and a hydrogen feeder 34 via a supply pipe 31. In other words, the distal end of the supply pipe 31 is connected to the intake port 30, and the proximal end thereof is divided into two branches, with one of the branches being connected to the helium feeder 32 and the other being connected to the hydrogen feeder 34. Also, a helium valve 33 is inserted between the branched point of the supply pipe 31 and the helium feeder 32, and a hydrogen valve 35 is inserted between the branched point and the hydrogen feeder 34.

The helium feeder 32 and the hydrogen feeder 34 are formed by, for example, a helium gas (He) cylinder and a hydrogen gas ($H_2$) cylinder, respectively, and feed helium gas and hydrogen gas, respectively. Opening the helium valve 33 causes helium gas to be supplied to the heat treatment space 15 from the intake port 30. Meanwhile, opening the hydrogen valve 35 causes hydrogen gas to be supplied to the heat treatment space 15 from the intake port 30. It is also possible to supply a mixed gas of helium gas and hydrogen gas to the heat treatment space 15 by opening both of the valves. Note that opening and closing of the helium valve 33 and the hydrogen valve 35 may be controlled by the control unit 90.

Meanwhile, the exhaust port 40 is connected in communication with a vacuum pump (exhaust pump) 45 via an exhaust pipe 41. An exhaust valve 46 is placed in the middle of the path of the exhaust pipe 41 that extends from the exhaust port 40 to the vacuum pump 45. Opening the exhaust valve 46 while operating the vacuum pump 45 allows the atmosphere inside the heat treatment space 15 to be discharged from the exhaust port 40. Meanwhile, operating the vacuum pump 45 to exhaust gas from the exhaust port 40 without supplying gas from the intake port 30 can create a vacuum atmosphere inside the heat treatment space 15. Note that a rotary pump may be used as the vacuum pump 45, for example.

The air pressure inside the heat treatment space 15 is measured by a pressure sensor 51. Additionally, the temperature inside the heat treatment space 15 is measured by a temperature sensor 52. The pressure and the temperature inside the heat treatment space 15 measured respectively by the pressure sensor 51 and the temperature sensor 52 are transmitted to the control unit 90.

The control unit 90 controls the above-described various operation mechanisms provided in the vacuum furnace 1. The hardware configuration of the control unit 90 is the same as that of a commonly used computer. That is, the control unit 90 includes, for example, a CPU that performs various arithmetic processing, a ROM serving as a read-only memory storing a basic program, a RAM serving as a readable and writable memory storing various types of information, and a magnetic disk in which control software, data and the like are stored in advance. The treatment in the vacuum furnace 1 in the control unit 90 proceeds as a result of the CPU executing a predetermined processing program. Specifically, the control unit 90 monitors the state of the heat treatment space 15 using the pressure sensor 51 and the temperature sensor 52, and, based on the measurement results obtained thereby, controls the amount of power supplied by the power supply source 13 and the opening and closing of the helium valve 33, the hydrogen valve 35, and the exhaust valve 46, for example.

Figure 2:
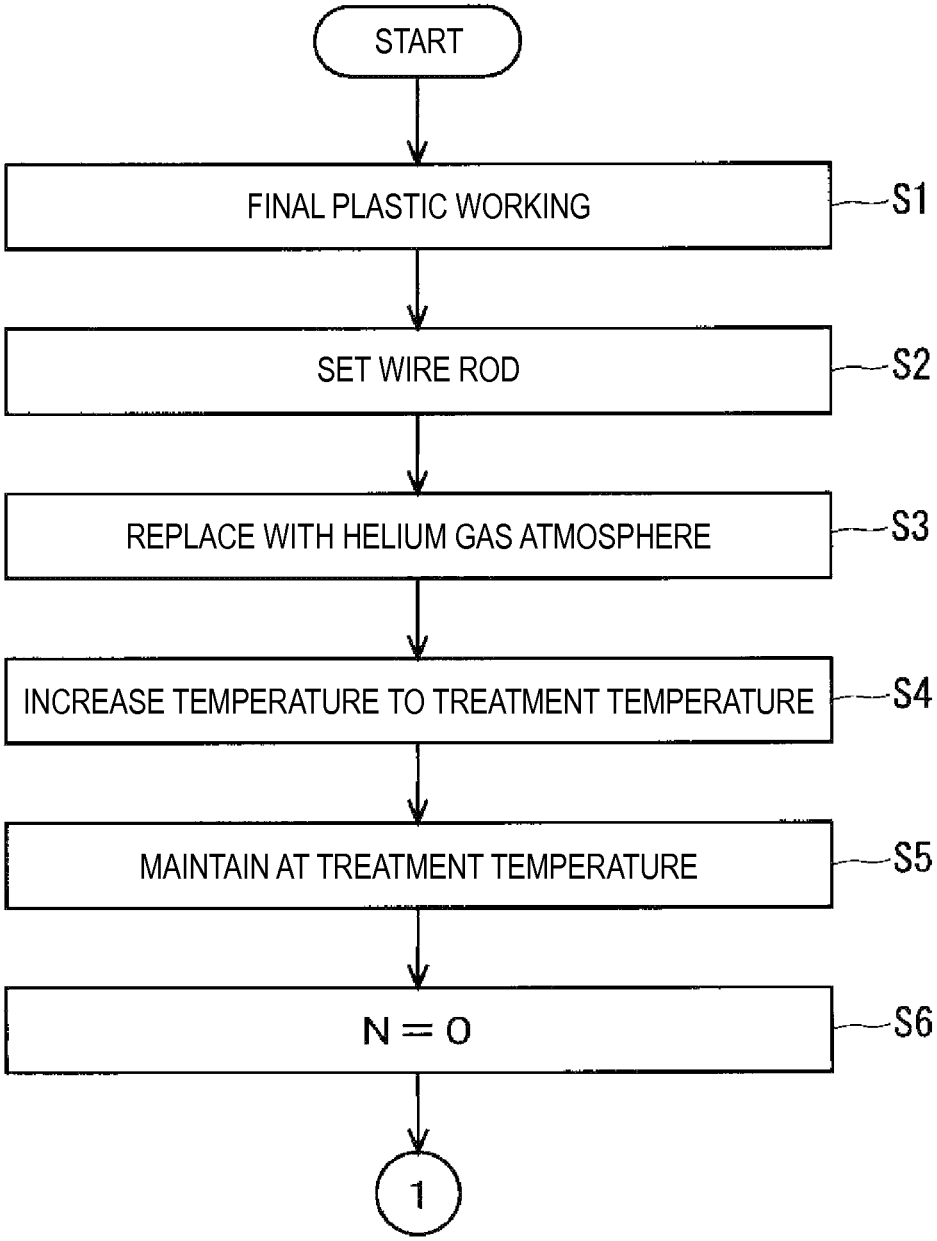
FIG. 2 is a flowchart illustrating the procedure of heat treatment in the vacuum furnace in FIG. 1.
Figure 3:
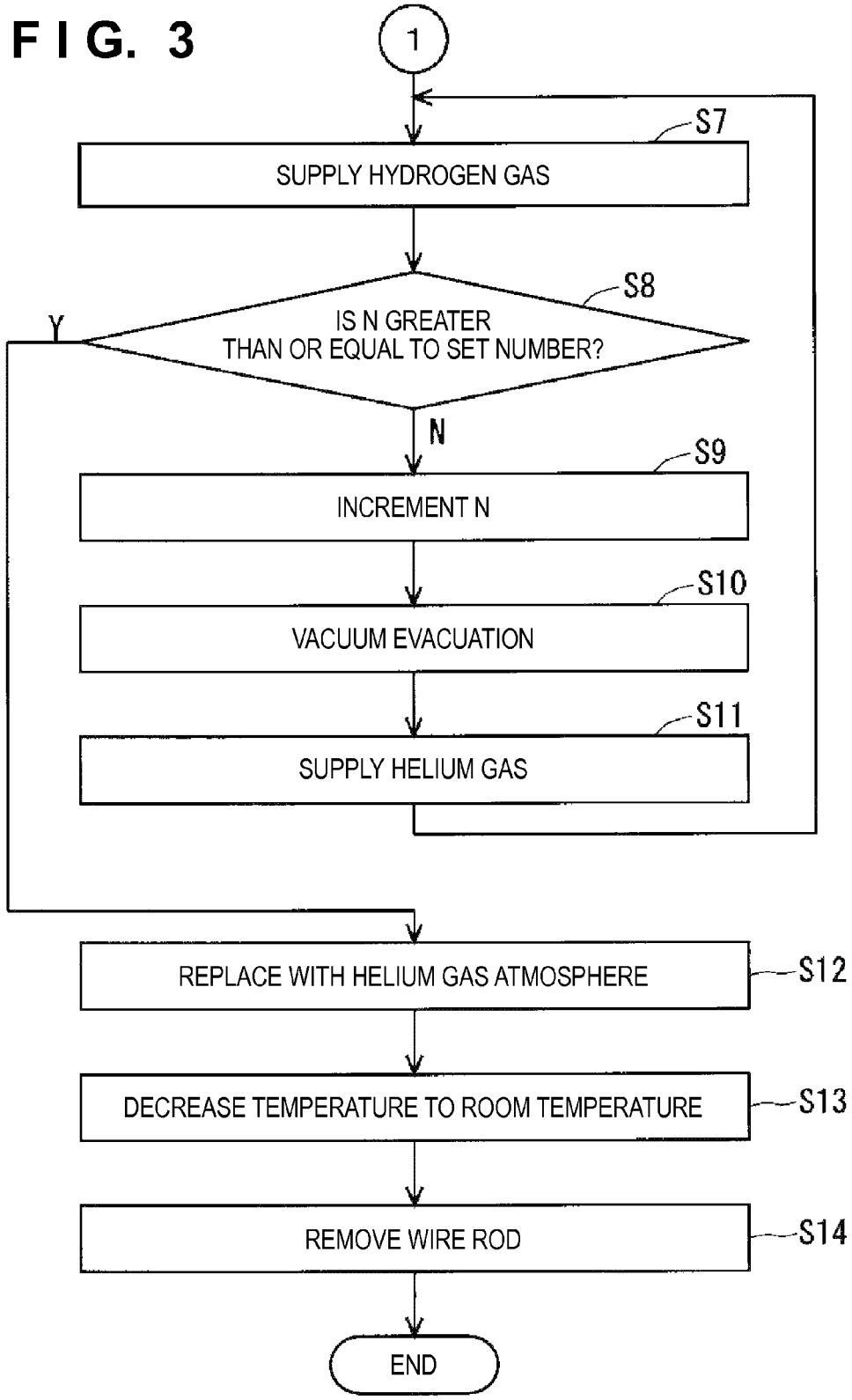
FIG. 3 is a flowchart illustrating the procedure of heat treatment in the vacuum furnace in FIG. 1.

Next, the procedure of heat treatment in the vacuum furnace 1 having the above-described configuration will be described. FIGS. 2 and 3 are flowchart illustrating the procedure of heat treatment in the vacuum furnace 1. Here, the metal material to be treated is a wire-like silver material (hereinafter, referred to as "silver wire"). Silver (Ag) is a noble metal having a face-centered cubic lattice structure (FCC structure), and its electrical conductivity is higher than that of copper (Cu). The purity of the silver material is preferably 4 N or more (99.99% or more).

In the present embodiment, first, final plastic working is performed on the silver material (step S1). Specifically, the silver material (for example, a silver rod member) is subjected to drawing to give a silver wire having a predetermined diameter. Drawing refers to working by which the silver material is pulled through a die having a die opening with the above-described predetermined diameter, thus forming a silver wire 20. Since the working performed in step S1 is final plastic working, no further plastic working will be performed. In other words, at the stage of step S1, the silver material is subjected to plastic working so as to have the shape of a finished product. Note that plastic working performed in step S1 is not limited to drawing, and may be different working, including, for example, casting, extruding, and rolling, according to the shape of the finished product.

Figure 5:
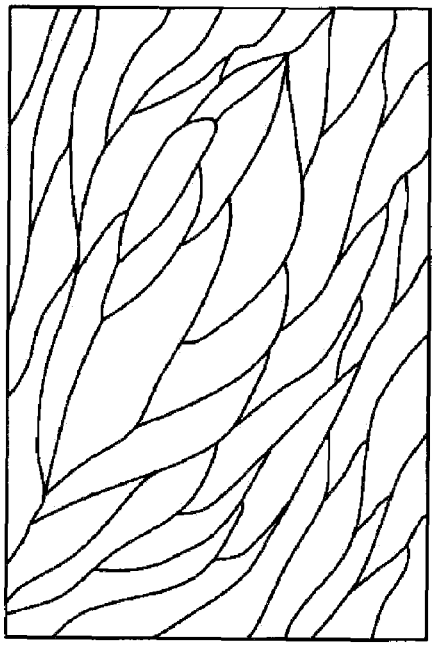
FIG. 5 depicts the crystal structure of a metal material having undergone final plastic working.

Since plastic working involves plastic deformation, the crystal structure is also subjected to deformation and a large number of lattice defects are introduced thereto. FIG. 5 depicts the crystal structure of the silver wire 20 having undergone final plastic working. The crystal grains extend along the drawing direction, and a large number of lattice defects are introduced also inside the crystal grains. The silver wire 20 having undergone such plastic working has a large number of lattice defects (vacancies, interstitial atoms, dislocations, stacking faults, grain boundary, and the like) introduced thereto, and therefore its electric conduction efficiency is lower than that of the original silver material.

The silver wire 20 having undergone such final plastic working that is wound around the quartz pipe 25 is set in the heat treatment space 15 of the vacuum furnace 1 (step S2). After the silver wire 20 is set in the furnace, the door (not shown) is closed to seal the heat treatment space 15. Then, the heat treatment space 15 is replaced with a helium gas atmosphere (step S3). Specifically, the exhaust valve 46 is opened while operating the vacuum pump 45, so as to temporarily create a vacuum atmosphere in the heat treatment space 15. Then, the exhaust valve 46 is closed and the helium valve 33 is opened to supply helium gas to the heat treatment space 15. At the point at which the heat treatment space 15 has reached a predetermined pressure, the helium valve 33 is closed.

Figure 4:
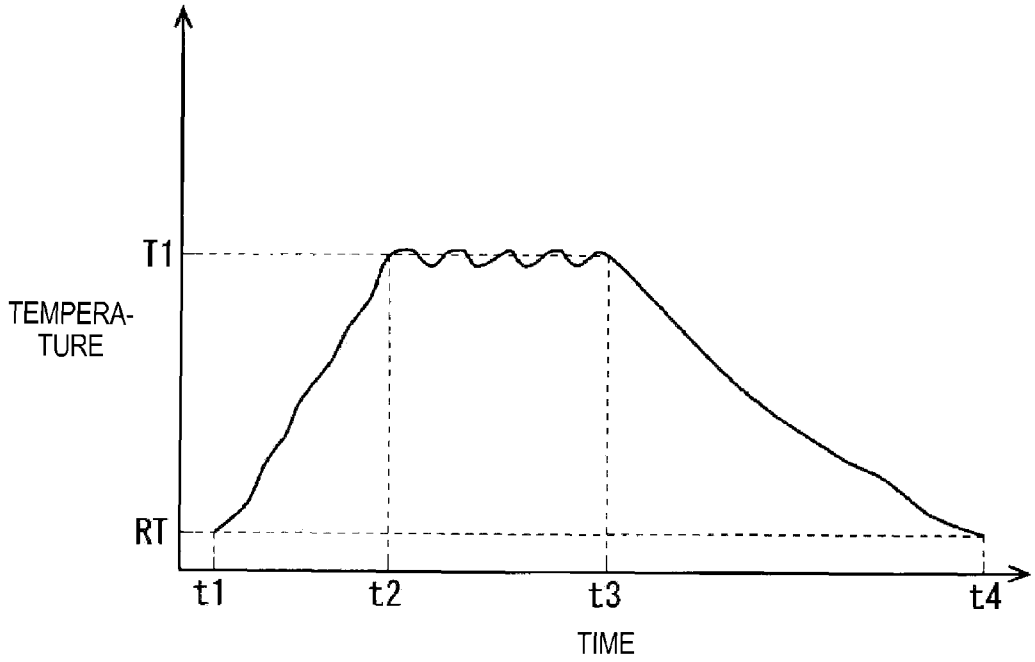
FIG. 4 is a graph showing the temperature change of a heat treatment space.

Next, the power supply from the power supply source 13 to the heating element 12 is started to increase the temperature of the heat treatment space 15 (step S4). FIG. 4 is a graph showing the temperature change of the heat treatment space 15. Upon the start of application of power to the heating element 12 at time t1, the temperature of the heat treatment space 15 increases, and eventually reaches a target treatment temperature T1 at time t2. Here, the treatment temperature T1 in the case of treating the silver wire 20 is 700° C. or more and less than the melting point of the silver wire 20. The treatment temperature T1 is 700° C. or more, and thus is significantly higher than the recrystallization temperature of silver (200° C. or less). Further, the melting point of the silver wire 20, which contains slight amounts of oxygen and other impurities, is different from the melting point of pure silver, which is 961° C. The target treatment temperature T1 is lower than the melting point of the silver wire 20, and is not necessarily lower than the melting point of pure silver. Note that the melting point of the silver wire 20 may be determined from the type and the content of impurities, or may be determined by performing heating test in advance.

To increase the temperature of the heat treatment space 15, the target treatment temperature T1 and the temperature increasing time from time t1 to time t2 are set in the control unit 90 in advance. Based on the result of measurement by the temperature sensor 52, the control unit 90 controls the amount of power supply from the power supply source 13 to the heating element 12 such that the temperature of the heat treatment space 15 reaches the treatment temperature T1 at time t2. The temperature control of the heat treatment space 15 by the control unit 90 is performed with PID (Proportional, Integral, Derivative) control.

The increased temperature of the heat treatment space 15 causes the temperature of the silver wire 20 having undergone final plastic working to be increased to the treatment temperature T1 of 700° C. or more and less than the melting point in the helium gas atmosphere. Since the helium gas is inert, it is possible to prevent any chemical reaction on the surface of the silver wire 20 during the temperature increase. Note that the temperature of the silver wire 20 may be increased to the treatment temperature T1 of 700° C. or more and less than the melting point in a vacuum atmosphere in the temperature increasing step from time t1 to time t2.

On and after time t2, at which the temperature of the heat treatment space 15 has reached the treatment temperature T1, the control unit 90 controls the amount of power supply of the power supply source 13 such that the temperature of the heat treatment space 15 is maintained at the treatment temperature T1 (step S5). In other words, the control unit 90 controls the amount of power supply from the power supply source 13 to the heating element 12 such that the result of measurement by the temperature sensor 52 is substantially maintained at the treatment temperature T1. Also, in the heating step from time t2 to time t3, atmosphere exchange is repeated in which a vacuum atmosphere is created in the area surrounding the silver wire 20 and a helium-hydrogen mixed atmosphere is created, while maintaining the temperature of the heat treatment space 15 at the treatment temperature T1. In the following, the description of this atmosphere exchange process will be continued.

First, the variable N is set to 0 (step S6). The variable N is a counter variable indicating the number of times of atmosphere exchange, and is retained in the memory of the control unit 90. Subsequently, the hydrogen valve 35 is opened to supply hydrogen gas to the heat treatment space 15 (step S7). A small amount of the hydrogen gas supply is sufficient, and thus the hydrogen valve 35 is closed shortly after the opening.

At and after time t2, the silver wire 20 is maintained at the treatment temperature T1 of 700° C. or more and less than its melting point. The treatment temperature T1 is significantly higher than the recrystallization temperature of silver, and thus recrystallization proceeds in the structure inside the silver wire 20 over a period from the temperature increasing step (from time t1 to time t2) to the heating step (from time t2 to time t3). That is, new distortion-free crystal grains (recrystallized grains) are generated and grow from the crystal grains to which a large number of lattice defects have been introduced by final plastic working in step S1. The degree of growth of the recrystallized grains mainly depends on the treatment temperature T1, and the recrystallized grains are more likely to be coarsened at a higher treatment temperature T1.

In the heating step at and after time t2, the recrystallization and the grain growth proceed in the internal structure of the silver wire 20, and hydrogen gas is introduced to the heat treatment space 15 to create a mixed atmosphere of hydrogen gas and helium gas in the area surrounding the silver wire 20. Hydrogen gas is a reducing gas used as a reducing agent, and thus reduction occurs as a result of the introduction of hydrogen gas to the area surrounding the silver wire 20 that has been heated to the treatment temperature T1. That is, any impurities such as oxygen ($O_2$) remaining in the silver wire 20 are reduced by hydrogen gas and are discharged from the silver wire 20 to the heat treatment space 15 as moisture (water vapor), for example.

Next, the procedure advances to step S8, in which it is determined whether the counter variable N is greater than or equal to the previously defined set number. This set number is the number of times that the atmosphere exchange is performed, and may be defined and set in the control unit 90 in advance (in this embodiment, the number of times is set to 10). If the counter variable N is less than the predetermined set number, the procedure advances to step S9, in which the value of the counter variable N is incremented by 1. Then, with the helium valve 33 and the hydrogen valve 35 kept being closed, the vacuum pump 45 is operated to open the exhaust valve 46, thus vacuum evacuating the heat treatment space 15 (step S10). The vacuum evacuation is performed until the pressure inside the heat treatment space 15 measured by the pressure sensor 51 reaches a predetermined degree of vacuum. This allows the atmosphere inside the heat treatment space 15 to be discharged to the outside of the vacuum furnace 1 so as to create a vacuum atmosphere in the area surrounding the silver material 20, and also allows water vapor and the like that have been produced by the above-described reduction to be discharged together with the atmosphere inside the heat treatment space 15.

At the point at which the pressure inside the heat treatment space 15 has reached the predetermined degree of vacuum, the exhaust valve 46 is closed to stop the vacuum evacuation, and the helium valve 33 is opened to supply helium gas to the heat treatment space 15 (step S11). At the point at which the pressure inside the heat treatment space 15 measured by the pressure sensor 51 is restored to the predetermined pressure, the helium valve 33 is closed. Although the temperature of the heat treatment space 15 momentarily drops below the treatment temperature T1 as a result of new helium gas having been supplied into the heat treatment space 15, it again increases to the treatment temperature T1 within a short period of time.

When the temperature of the heat treatment space 15 reaches the treatment temperature T1 again, the procedure returns to step S7 again, in which the hydrogen valve 35 is opened to supply hydrogen gas to the heat treatment space 15. In the same manner as described above, the hydrogen valve 35 is closed shortly after the opening. The introduction of new hydrogen gas to the area surrounding the silver wire 20 causes any impurities such as oxygen still remaining in the silver wire 20 to be reduced and discharged to the heat treatment space 15. Thereafter, the procedure from step S7 to step S11 is repeated until the counter variable N becomes greater than or equal to the previously defined set number (here, 10). That is, for the previously defined number of times of atmosphere exchange, atmosphere exchange is repeated in which a vacuum atmosphere is created in the area surrounding the silver wire 20 by evacuation and then helium gas and hydrogen gas are supplied to create a mixed atmosphere thereof.

In this manner, in the heating step from time t2 to time t3, the silver wire 20 is maintained at the treatment temperature T1 of 700° C. or more and less than its melting point to promote the recrystallization and the grain growth, and in a part of the heating step, the silver wire 20 is heated in a mixed atmosphere in which hydrogen gas is mixed with helium gas. Speaking more specifically regarding the atmosphere in the heat treatment space 15 in the heating step, atmosphere exchange is repeated 10 times, in which a vacuum atmosphere is created in the area surrounding the silver wire 20 by evacuation and then helium gas and hydrogen gas are supplied to create a mixed atmosphere. This allows distortion-free recrystallized grains to be coarsened to reduce the number of grain boundaries, making it possible to eliminate any impurities such as oxygen unevenly distributed in grain boundaries by reduction using hydrogen gas.

If the counter variable N has become greater than or equal to the predetermined set number in step S8, the heating step ends and the procedure advances to step S12, in which the heat treatment space 15 is replaced with a helium gas atmosphere. Specifically, as with step S3, the exhaust valve 46 is opened while operating the vacuum pump 45 to temporarily create a vacuum atmosphere in the heat treatment space 15, and then the exhaust valve 46 is closed and the helium valve 33 is opened to supply the helium gas to the heat treatment space 15. At the point at which the heat treatment space 15 has reached the predetermined pressure, the helium valve 33 is closed.

Upon completion of the heating step, the heat treatment space 15 is replaced with a helium gas atmosphere, and the amount of power supply from the power supply source 13 is reduced at time t3 to gradually lower the output of the heating element 12 (step S13). When the amount of power supply from the power supply source 13 is reduced at time t3, the temperature of the heat treatment space 15 is gradually lowered, and is eventually decreased to room temperature (RT) at time t4. The period from time t3 to time t4 constitutes a cooling step, and the silver wire 20 is annealed by gradually lowering the temperature of the heat treatment space 15.

The time for the cooling step (i.e., the period from time t3 to time t4) is at least twice the total time of the time for the temperature increasing step and the time for the heating step (i.e., the period from time t1 to time t3). To cool the heat treatment space 15, the cooling period from time t3 to time t4 is set in the control unit 90 in advance. Based on the result of measurement by the temperature sensor 52, the control unit 90 controls the amount of power supply from the power supply source 13 to the heating element 12 such that the temperature of the heat treatment space 15 is decreased to room temperature at time t4. Note that the temperature of the silver wire 20 may be decreased to room temperature in a vacuum atmosphere in the cooling step from time t3 to time t4.

At and after time t4 at which the temperature of the heat treatment space 15 has reached room temperature, the door (not shown) is opened to open the heat treatment space 15, and the quartz pipe 25 around which the silver wire 20 is wound is removed from the vacuum furnace 1 (step S14). Then, the silver wire 20 is unwound from the quartz pipe 25, which is directly provided as a finished product. In the above-described manner, the procedure of the heat treatment in the vacuum furnace 1 is completed.

In the present embodiment, the silver wire 20 is maintained at the treatment temperature T1 of 700° C. or more and less than its melting point to promote the recrystallization and the grain growth in the heating step from time t2 to time t3, and in a part of the heating step, the silver wire 20 is heated in a mixed atmosphere in which hydrogen gas is mixed with helium gas. Heating the silver wire 20 to the treatment temperature T1 of 700° C. or more, which is significantly higher than the recrystallization temperature, and less than its melting point allows distortion-free recrystallized grains to be coarsened, thus reducing the number of grain boundaries of the structure as a whole. Further, no lattice defects such as vacancies and dislocations exist in the recrystallized grains.

When the overall structure of the silver wire 20 is changed into recrystallized grains, only remaining main lattice defects are grain boundaries, and impurities such as oxygen are unevenly distributed in the grain boundaries. Since the silver wire 20 is heated in a mixed atmosphere in which hydrogen gas is mixed with helium gas in the present embodiment, impurities such as oxygen unevenly distributed in the grain boundaries after recrystallization are eliminated by being reduced by hydrogen gas, and at least either helium molecules or hydrogen molecules enter the grain boundaries.

Figure 6:
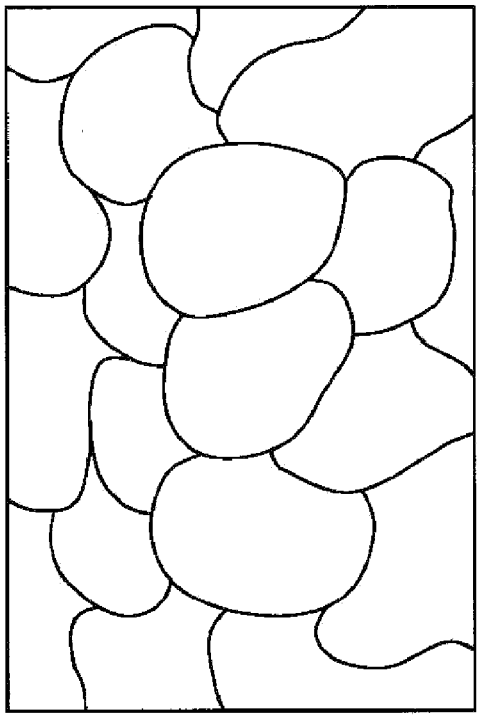
FIG. 6 depicts the crystal structure of a metal material for which a cooling step has been completed.
Figure 7:
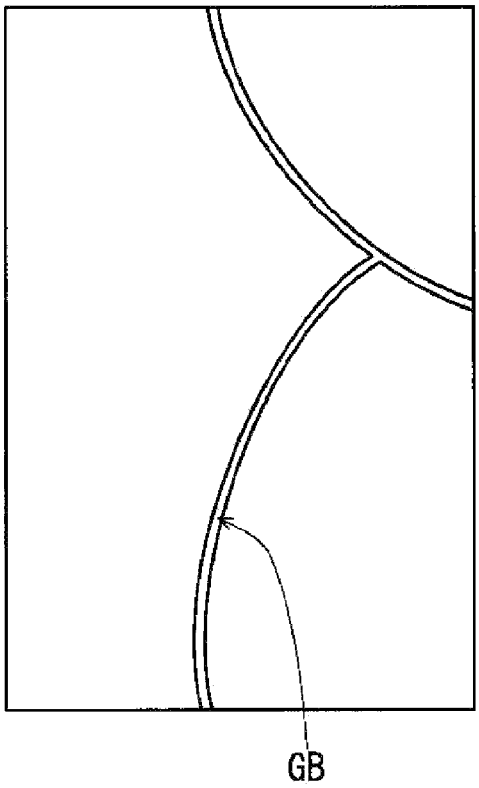
FIG. 7 is an enlarged view of the vicinity of the grain boundaries in FIG. 6.

FIG. 6 depicts the crystal structure of the silver wire 20 for which the cooling step has been completed. FIG. 7 is an enlarged view of the vicinity of the grain boundaries GB in FIG. 6. As is evident from comparison with FIG. 5, the silver wire 20 having undergone final plastic working is maintained at 700° C. or more and less than its melting point, and thereby the overall structure has become a recrystallized structure. Also, impurities such as oxygen unevenly distributed in the grain boundaries GB, which are the boundaries between adjacent recrystallized grains, are eliminated by being reduced by hydrogen gas, providing a structure in which at least either helium molecules or hydrogen molecules are filled in place of such impurities.

In the silver wire 20 having such a crystal structure, the overall structure is constituted by defect-free recrystallized grains, and thus has a higher electrical conductivity. Also, since the recrystallized grains are coarsened, the structure has fewer grain boundaries as a whole, which also results in a higher electrical conductivity. Furthermore, at least either helium molecules or hydrogen molecules, which have a low molecular weight, are filled in the grain boundaries, which are the only defects in the treated silver wire 20, and this can significantly reduce the influence of grain boundaries on the electrical conductivity. As a result, it is possible to impart high electric conduction efficiency to the silver wire 20.

With the manufacturing method according to the present invention, batch production can be achieved by accommodating a considerable amount of a silver material in the vacuum furnace 1 and performing one heat treatment. For example, by setting the quartz pipe 25 with the silver wire 20 of several tens of meters or more therearound in the vacuum furnace 1, it is possible to manufacture a large quantity of silver wires 20 by one heat treatment in the form of finished products. That is, the manufacturing method according to the present invention also has excellent mass productivity.

The electric conduction efficiency is increased by using such a silver wire 20 as the wiring material for electronic components or connecting it to a grounding site, and thus no burden is placed on the operation of the electronic components. Consequently, the probability of failures is also reduced.

By using the silver wire 20 having excellent electric conduction efficiency as the bonding wire of a semiconductor chip, it is possible to allow the semiconductor chip to exert its original processing capability, and it is also possible to contribute to an improvement in the processing capability of a computer using the same.

The use of the silver wire 20 as a power transmission cable significantly reduces losses and unnecessary release of electromagnetic waves, thus making it also possible to make a contribution regarding environment problems in various fields, including energy problems.

Furthermore, it is possible to produce a silver coil and a dynamo using the same by providing the silver wire 20 with coating. In the case of producing a silver coil, it is necessary to provide the surface of a wire-like silver material with coating of enamel, vinyl or the like, but it was not possible to provide commonly used silver materials with such coating. The reason is that, in the case of a commonly used silver material, the surface reacts with enamel to produce a sulfide, resulting in deterioration in an electrical conduction properties and physical strength. The same applies to vinyl, in which case sulfide gas or the like is released and reacts with the surface. The silver wire 20 according to the present invention is corrosion resistant, or in other words, is resistant to chemical substances, and thus will not suffer from deterioration in the properties even if it is coated with enamel or vinyl. This makes it possible to produce a silver coil. These achievements allow for collection of energy with very high efficiency, and as a result, it is possible to ensure an environmentally friendly energy source.

The silver wire 20 can also be used as a high-performance electric contact. A commonly used electric contact undergoes migration (a phenomenon in which metal atoms in a wire gradually move, for example, as a result of electrons flowing though the wire collide therewith), causing a contact failure. In contrast, the silver wire 20 according to the present invention has high corrosion resistance and does not easily undergo migration, making it possible to achieve a high-performance electric contact.

Although an embodiment of the present invention has been described above, various modifications, other than the above-described embodiment, may be made to the invention without departing from the spirit or essential characteristics thereof. For example, although the silver wire 20 is provided by final plastic working (step S1) in the above-described embodiment, the invention is not limited thereto and the material obtained after final plastic working may be in the form of a plate-shaped material, a band-shaped material, or a pipe-shaped material, or may be in a more complex form. That is, it is possible to adopt any configuration as long as the silver material that has been shaped into a finished product by final plastic working is treated by the manufacturing method according to the present invention.

Although in the above-described embodiment, atmosphere exchange is repeated 10 times, in which a vacuum atmosphere is created in the heat treatment space 15 and then a mixed atmosphere of helium gas and hydrogen gas is created, it is sufficient that such atmosphere exchange is performed at least three times. Repeating the atmosphere exchange three times or more allows impurities such as oxygen unevenly distributed in the grain boundaries to be eliminated by reduction with hydrogen gas. However, the number of times of atmosphere exchange is preferably as many as possible in order to reliably cause helium molecules or hydrogen molecules to enter the grain boundaries.

In place of the silver material, a copper material (Cu) having undergone final plastic working may be treated by the manufacturing method according to the present invention. In the case of the copper material as well, the configuration of the vacuum furnace 1 is exactly the same. The treatment temperature T1 in the case of treating the copper material is 800° C. or more and less than the melting point of the copper material. The treatment temperature T1 is 800° C. or more, and is significantly higher than the recrystallization temperature of copper (200° C. to 250° C.). While maintaining the copper material at the treatment temperature T1 of 800° C. or more and less than the melting point to promote the recrystallization and the grain growth, the same atmosphere exchange as that in the above-described embodiment is repeated three times or more. Also, the time for the cooling step is at least twice the total time of the time for the temperature increasing step and the time for the heating step. The rest of the manufacturing method is the same as that of the above-described embodiment.

In this manner as well, the overall structure of the copper material can be constituted by coarsened, recrystallized grains, and at least either helium molecules or hydrogen molecules are filled in the grain boundaries of the recrystalized grains. This makes it possible to impart high electric conduction efficiency with the copper material by the same effect as in the case of the silver material.

In place of the silver material, an aluminum material (Al) having undergone final plastic working may be treated by the manufacturing method according to the present invention. In the case of the aluminum material as well, the configuration of the vacuum furnace 1 is exactly the same. The treatment temperature T1 in the case of treating the aluminum material is 500° C. or more and less than the melting point of the aluminum material. The treatment temperature T1 is 500° C. or more, and thus is significantly higher than the recrystallization temperature of aluminum (150° C. to 240° C.). While maintaining the aluminum material at the treatment temperature T1 of 500° C. or more and less than the melting point to promote the recrystallization and grain growth, the same atmosphere exchange as that in the above-described embodiment is repeated three times or more. Also, the time for the cooling step is at least twice the total time of the time for the temperature increasing step and the time for the heating step. The rest of the manufacturing method is the same as that in the above-described embodiment.

In this manner as well, the overall structure of the aluminum material can be constituted by coarsened, recrystallized grains, and at least either helium molecules or hydrogen molecules are filled in the grain boundaries of the recrystallized grains. This makes it possible to impart high electric conduction efficiency to the aluminum material by the same effect as in the case of the silver material.

Although the atmosphere exchange in the heat treatment space 15 was performed under control of the control unit 90 in the above-described embodiment, this may be performed by the worker manually opening and closing the valves.

In place of helium, other inert gases, including, for example, argon gas may be used. Also, a hydrogen-containing gas may be used in place of hydrogen gas.

Furthermore, the configuration of the vacuum furnace 1 is not limited to FIG. 1, and a mechanism for applying a strong electric field may be added on the back side of the heating element 12, for example.

The metal material according to the present invention is applicable in a wide variety of fields, including, for example, anti-static units, printed boards, capacitors, antennas for communication devices, bonding wires for semiconductor chips, lead frames, wiring materials for automobile power supply systems, lead wires for solar power generation, lighting rods, wiring materials for medical equipment, sensing materials for sensing electrons, electric contacts, connectors, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2010-230325, filed Oct. 13, 2010, which is hereby incorporated by reference herein in its entirety.

What is claimed is:

1. A method for manufacturing a metal material, comprising:

a temperature increasing step of increasing the temperature of a silver material having undergone final plastic working to 700° C. or more and less than a melting point of the silver material in a vacuum or an inert gas atmosphere;

a heating step of maintaining the silver material at 700° C. or more and less than the melting point; and a cooling step of cooling the silver material to room temperature in a vacuum or an inert gas atmosphere, wherein, for a part of the period of the heating step, the silver material is heated in a mixed atmosphere in which hydrogen gas is mixed with an inert gas, and wherein as a result of the heating and cooling steps, a number of lattice defects in the silver material is reduced.

2. The method according to claim 1, wherein, during the heating step, atmosphere exchange is repeated three times or more, in which a vacuum atmosphere is created in an area surrounding the silver material by evacuation and then an inert gas and hydrogen gas are supplied to create the mixed atmosphere.

3. The method according to claim 1, wherein the time for the cooling step is at least twice the total time of the time for the temperature increasing step and the time for the heating step.

* * * * *